US007771216B2

(12) United States Patent
Grems et al.

(10) Patent No.: US 7,771,216 B2
(45) Date of Patent: Aug. 10, 2010

(54) ROTATING POWER OUTLET ASSEMBLY OR DOOR

(75) Inventors: Lisa A. Grems, West Bloomfield, MI (US); Daniel V. Beckley, Byron, MI (US)

(73) Assignee: Intier Automotive Inc., Newmarket, Ontario (CA)

( * ) Notice: Subject to any disclaimer, the term of this patent is extended or adjusted under 35 U.S.C. 154(b) by 0 days.

(21) Appl. No.: 12/281,778

(22) PCT Filed: Mar. 6, 2007

(86) PCT No.: PCT/CA2007/000345

§ 371 (c)(1),
(2), (4) Date: Sep. 5, 2008

(87) PCT Pub. No.: WO2007/101333

PCT Pub. Date: Sep. 13, 2007

(65) Prior Publication Data

US 2009/0029577 A1 Jan. 29, 2009

Related U.S. Application Data

(60) Provisional application No. 60/779,569, filed on Mar. 6, 2006.

(51) Int. Cl.
*H01R 13/44* (2006.01)

(52) U.S. Cl. ..... 439/131; 439/138; 439/142; 439/373; 439/528

(58) Field of Classification Search ..... 439/131, 439/138, 142, 373, 528
See application file for complete search history.

(56) References Cited

U.S. PATENT DOCUMENTS

| | | | | |
|---|---|---|---|---|
| 3,094,237 | A | 6/1963 | Ryuji | |
| 4,713,017 | A | 12/1987 | Pesapane | |
| 5,102,181 | A | 4/1992 | Pinkney | |
| 5,122,069 | A * | 6/1992 | Brownlie et al. | 439/131 |
| 5,314,103 | A | 5/1994 | Li | |
| 5,382,171 | A | 1/1995 | Hofmann et al. | |
| 5,855,308 | A | 1/1999 | Ziegler et al. | |
| 6,447,078 | B1 | 9/2002 | Zheng | |
| 6,474,431 | B1 | 11/2002 | Baker et al. | |
| 6,854,989 | B2 * | 2/2005 | Milan | 439/131 |
| 6,873,808 | B2 * | 3/2005 | Ueda | 439/131 |
| 6,999,695 | B2 * | 2/2006 | Ueda | 439/131 |
| 7,064,268 | B2 * | 6/2006 | Dinh | 439/138 |
| 7,104,580 | B2 | 9/2006 | Clark et al. | |
| 2002/0081878 | A1 | 6/2002 | Bruno | |
| 2003/0194906 | A1 | 10/2003 | Arkin et al. | |
| 2005/0014408 | A1 | 1/2005 | Swiatek et al. | |

* cited by examiner

*Primary Examiner*—Tho D Ta
(74) *Attorney, Agent, or Firm*—Honigman Miller Schwartz and Cohn LLP

(57) ABSTRACT

The present invention is an accessory jack for use in an interior panel of an automobile, having a rotating assembly, including two or more sides. An accessory jack is operably associated with the rotating assembly and a pivot point. In a first embodiment, the pivot point is located in the center of the rotating assembly equidistant from the two or more sides, along a substantially vertical axis. In a second embodiment, the pivot point is located where one of the two or more sides connects to another of the two or more sides, along a substantially vertical axis. The rotating assembly rotates about the pivot point, exposing the accessory jack, making the accessory jack available for use.

10 Claims, 2 Drawing Sheets

ROTATING POWER OUTLET ASSEMBLY OR DOOR

CROSS-REFERENCE TO RELATED APPLICATIONS

This application claims the benefit of U.S. Provisional Application No. 60/779,569, filed Mar. 6, 2006.

FIELD OF THE INVENTION

The present invention relates to the packaging of an accessory jack used in the interior of automobiles.

BACKGROUND OF THE INVENTION

Power outlets and accessory jacks are a common feature in an automobile interior. With the development of various modern conveniences, and increased amount of travel in automobiles, accessory jacks are more commonly used than ever before. They are used to power many various devices such as cell phones, and the like.

Current accessory jacks used inside an automobile interior require a hinged cap to provide access. The caps are often times a molded component which is black in color; this type of cap may not match the interior of the vehicle and can take away from the "clean" look of the interior component, such as the instrument panel or floor console, where the jack is located. Other methods to conceal the accessory jack are to incorporate the jack into a component of the vehicle, such as the ash tray.

Accordingly, there exists a need for an improved type of accessory jack which can be better concealed in the automobile without detracting from the appearance of the automobile interior.

SUMMARY OF THE INVENTION

The present invention is an accessory assembly, having a rotating assembly including a two or more sides, an accessory jack, operably associated with the rotating assembly; and a pivot point wherein the rotating assembly rotates about the pivot point, exposing the accessory jack, making the accessory jack available for use.

In a first embodiment, the pivot point is located in the center of the rotating assembly equidistant from the two or more sides, along a substantially vertical axis. The accessory jack is mounted inside the rotating assembly, and is accessible on one of the two or more sides. When the rotating assembly is rotated about the pivot point, one of the two or more sides is no longer exposed, and another of the two or more sides is exposed to the vehicle passengers.

In a second embodiment, the pivot point is located where one of the two or more sides connects to another of the two or more sides, along a substantially vertical axis. The accessory jack is located behind one of the two or more sides, and is not connected to the rotating assembly. When the rotating assembly is rotated about the pivot point, the rotating assembly is positioned inside the vehicle panel, exposing the accessory jack.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
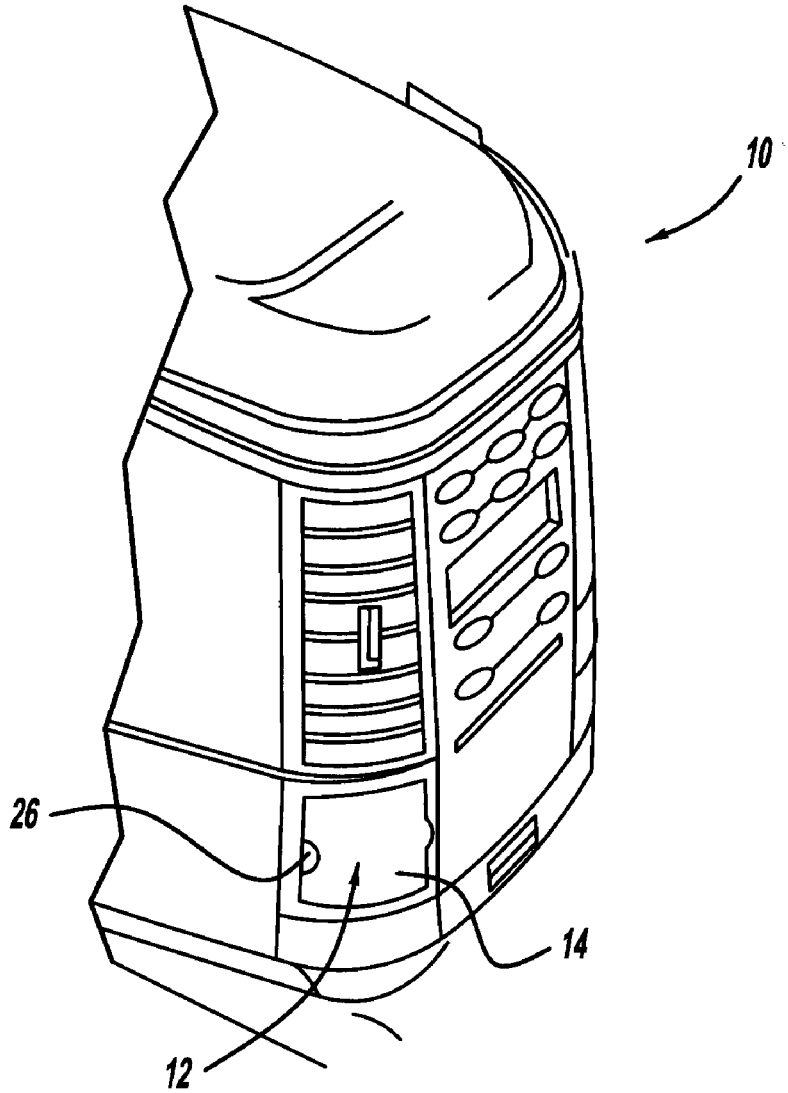
FIG. 1 is a vehicle panel commonly used inside an automobile, incorporating the present invention.
Figure 2A:
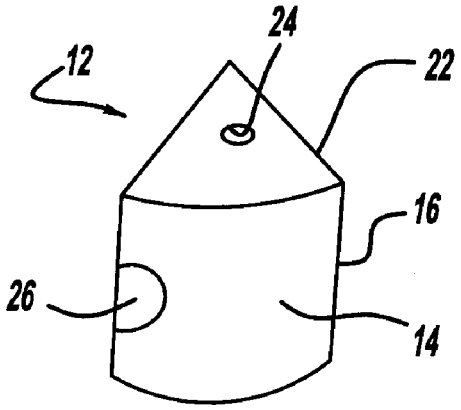
FIG. 2*a* is a first perspective view of a first embodiment, according to the present invention.
Figure 2B:
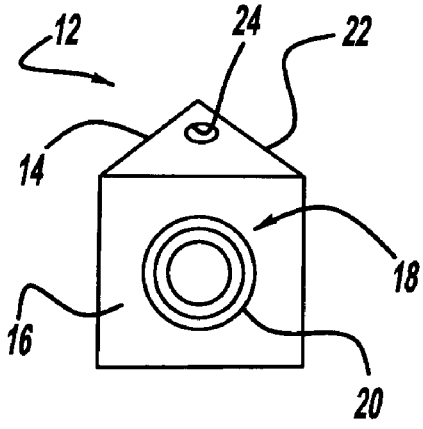
FIG. 2*b* is a second perspective view of a first embodiment, according to the present invention.

Referring now to all the Figures, a vehicle panel incorporating an accessory assembly according to the present invention is shown generally at 10. The panel 10 has various notches, buttons, and other components for operating the various features of the vehicle. The panel 10 can be a center armrest console, a headliner, an instrument panel, or any type of interior automotive panel where an accessory input can be placed. A rotating assembly having at least two sides, generally shown at 12, in this embodiment has a first side 14 which matches the color and the contour of the panel 10 where the rotating assembly 12 is placed. In the first embodiment, shown in FIGS. 2*a* and 2*b*, the rotating assembly 12 also has a second side 16, which includes the face, generally shown at 18, of a an accessory jack 20. In this embodiment, the accessory jack 20 is located inside the rotating assembly 12, and has the face 18 exposed on the second side 16.

Rotating assembly 12 also has a pivot point 24 located along a vertical axis generally equidistant from the first side 14, second side 16, and a third side 22. In operation, when accessory jack 20 is not in use, the rotating assembly 12 is positioned such that the first side 14 having the similar contour as the panel 10 is exposed. When the use of the accessory jack 20 becomes necessary, the rotating assembly 12 is rotated so the second side 16 having the face 18 of the accessory jack 20 becomes accessible to the passengers. The first side 14 includes a notch 26 which can be pushed and used to initiate the rotation of the rotating assembly 12. Once the face 18 of the accessory jack 20 becomes accessible, the accessory jack 20 can be used to power any number of portable electronic devices.

Figure 3A:
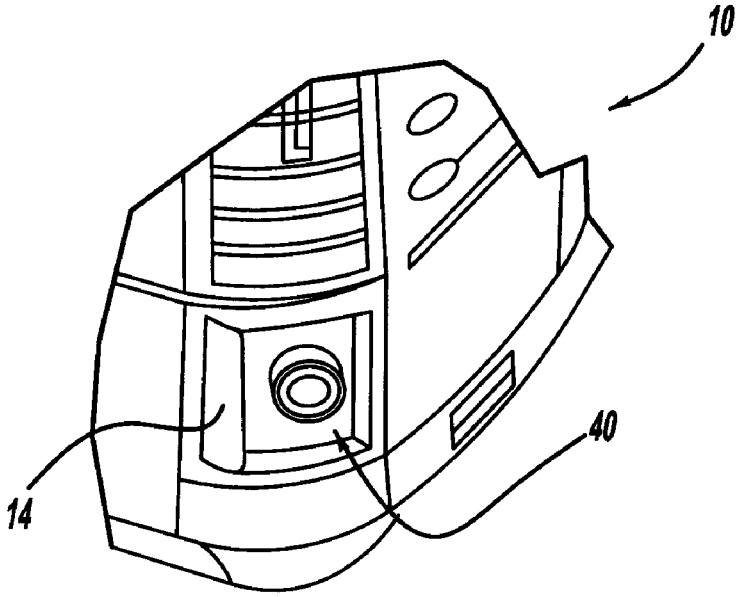
FIG. 3*a* is a perspective view of a vehicle panel incorporating an accessory jack, according to a second embodiment of the present invention.
Figure 3B:
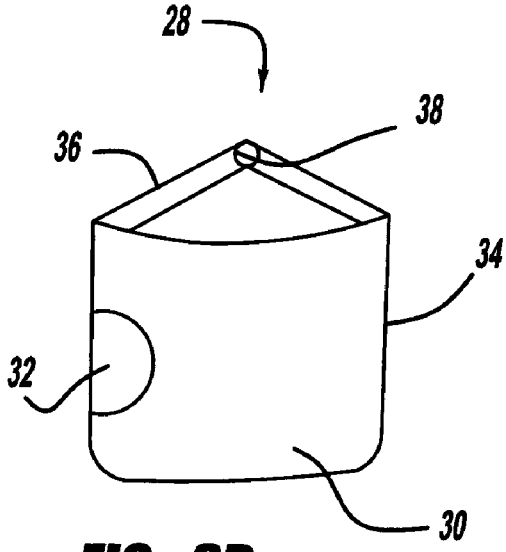
FIG. 3*b* is a perspective view of a rotating assembly, according to a second embodiment of the present invention.

A second embodiment of the present invention is similar to the first embodiment, and is shown in FIGS. 3*a* and 3*b*. In the second embodiment, the rotating assembly, generally shown at 28, includes a first side 30 having a notch 32, along with a second side 34 and a third side 36. The second embodiment also has a pivot point 38 which is located where the second side 34 and the third side 36 connect. The accessory jack, generally shown at 40 in the second embodiment, is fixed inside the vehicle panel 10, and does not move, or rotate with the rotating assembly 28.

In the second embodiment, when the accessory jack 40 needs to be accessed, the notch 32 is pressed to initiate rotation of the rotating assembly 28. As the rotating assembly 28 rotates about the pivot point 38, the first side 30 is positioned inside the vehicle panel 10, exposing the accessory jack 40 for use.

In either embodiment, the accessory jack 20,40 could be any number of different devices. The accessory jack 20,40 could be a power outlet for providing 110V or 12V power, or the accessory jack 20,40 could provide a connection for Ethernet, phone, USB ports, digital music players, computer connections, or the like.

The rotating assembly 12 can be triangular as shown or can be any number of sides such that at least one side has or can include an accessory jack and a second side has an interior matching side. Multiple jacks could be provided, or various sides of the rotating assembly could be used to provide, for instance, 110V power, 12V power, Ethernet, phone, USB ports, a digital music player, computer connections, and the like.

The swivelable contact can be selected from any design that allows for maintaining proper electrical contact while turning the rotating assembly 28. In its simplest form, the contacts are hard wired to the car's wiring harness with enough slack to facilitate rotating movement. More elaborate sliding, or rotatable contacts could also be used without departing from the scope of the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An accessory jack for use in the interior of an automobile, comprising:

an interior panel of an automobile that defines a boundary;

a rotating assembly disposed within said interior panel, said rotating assembly having a first side matching a contour of said interior panel at said boundary, a second side, and a third side, said rotating assembly rotatable about a pivot point;

an accessory jack operably associated with said rotating assembly, wherein when said accessory jack is not in use, said first side will be exposed and aligned with said interior panel, and when said accessory jack is to be accessed, said rotating assembly will rotate about said pivot point, exposing said accessory jack, and wherein said rotating assembly and said accessory jack do not extend beyond the panel boundary when said accessory jack is exposed.

2. The accessory jack for use in the interior of an automobile of claim 1, wherein said pivot point is located along a vertical axis equidistant from said first side, said second side, and said third side.

3. The accessory jack for use in the interior of an automobile of claim 1, said second side further comprising a plurality of accessory jacks.

4. The accessory jack for use in the interior of an automobile of claim 1, wherein said accessory jack is one selected from the group consisting of a power outlet, Ethernet connection, phone connector, a USB port, digital music player jack, and a computer connector.

5. The accessory jack for use in the interior of an automobile of claim 1, said accessory jack being mounted on said second side of said rotating assembly.

6. The accessory jack for use in the interior of an automobile of claim 5, when said rotating assembly is rotated about said pivot point, said accessory jack is exposed for use.

7. The accessory jack for use in the interior of an automobile of claim 1, where said pivot point is located where said second side connects to said third side along a vertical axis.

8. The accessory jack for use in the interior of an automobile of claim 7, said accessory jack being disposed within said interior panel and is separate from said rotating assembly.

9. The accessory jack for use in the interior of an automobile of claim 7, said rotating assembly is positioned behind said interior panel, exposing said accessory jack.

10. A power outlet for use in the interior of an automobile, comprising:

an interior panel disposed within an automobile;

a rotating assembly having a first side, a second side and a third side, said first side connected to said second side and said third side, and said second side connected to said third side; a notch formed in said first side for pivoting said rotating assembly about a pivot point;

a power outlet, operably associated with said rotating assembly, wherein when said rotating assembly is rotated about said pivot point, said rotating assembly can be rotated to expose either of said first side, said second side or said third side of said rotating assembly, and said rotating assembly can be rotated to expose said power outlet to the interior of said automobile.

* * * * *